US005766087A

United States Patent [19]

Kawamatsu

[11] Patent Number: 5,766,087

[45] Date of Patent: Jun. 16, 1998

[54] SET OF GOLF CLUBS

[75] Inventor: Hideaki Kawamatsu, Miyakonojo, Japan

[73] Assignee: Sumitomo Rubber Industries, Ltd., Hyogo, Japan

[21] Appl. No.: 784,537

[22] Filed: Jan. 21, 1997

[30] Foreign Application Priority Data

Jan. 23, 1996 [JP] Japan ..... 8-030044

[51] Int. Cl.[6] ..... A63B 53/04

[52] U.S. Cl. ..... 473/290; 473/331

[58] Field of Search ..... 473/330, 331, 473/290

[56] References Cited

U.S. PATENT DOCUMENTS 4,854,581 8/1989 Long ..... 473/290

5,591,092 1/1997 Gilbert ..... 473/331

FOREIGN PATENT DOCUMENTS 5-317463 12/1993 Japan .

*Primary Examiner*—Sebastiano Passaniti

*Assistant Examiner*—Stephen L. Blau

*Attorney, Agent, or Firm*—Armstrong, Westerman, Hattori, McLeland & Naughton

[57] ABSTRACT

A set of golf clubs including a number of golf clubs which are numbered serially and having progressively increasing loft angles from long irons to short irons. In a cross section of a number of face line grooves arranged on a striking face, the striking face and a groove slope face form a corner portion having a cross-sectional angle which decreases gradually from the long irons to the short irons.

6 Claims, 2 Drawing Sheets

SET OF GOLF CLUBS

BACKGROUND OF THE INVENTION

1. Field of the Invention

This invention relates to a set of golf clubs.

2. Description of the Related Art

A set of golf irons typically includes a number of iron clubs called long irons designed to impart a long distance to a ball, short irons designed to impart a short distance to a ball, and middle irons designed to impart a middle distance to a ball. In general, the iron clubs are respectively numbered (or named), beginning with the long irons and progressing to the short irons, three through nine and a pitching wedge, and in some cases, adding an alternative wedge and a sand wedge.

A striking face of each club head has a number of face line grooves, and the grooves influence an amount of back spin imparted to a ball. The amount of back spin considerably influences a trajectory of the ball, and changes the results such as a distance, orientability, and stability of the ball.

In a conventional set of golf clubs, the face line grooves on the striking face are generally composed to have identical concept (the same configuration in a cross section and the same intervals) in all the irons. In this case, the grooves are not designed to improve function of back spin efficiency. In order to decrease back spin and impart a longer distance to the ball by using a long iron or increase back spin and ability to control the ball by using a short iron, it is necessary to change a type of swing according to the iron. However, it is difficult for an average player to change a type of swing and attain acceptable results.

As an exception, Japanese provisional publication No. 5-317463 discloses improving function of the long irons and the short irons by changing intervals between the face line grooves from iron to iron.

However, it is difficult to arrange the spacing between the grooves to be half the conventional spacing by only changing the pitch or spacing of the grooves from iron to iron, as described in the foregoing, without violating Rule 4.1e of the Rules of Golf of the Royal and Ancient Golf Club of St. Andrews. Thereby, influence upon the amount of back spin imparted to the ball by such groove spacing is not sufficient. Moreover, a set of clubs having grooves arranged at intervals different from iron to iron is visually objectionable by many players.

It is therefore an object of the present invention to provide a set of golf clubs wherein the foregoing problems are solved. It is possible to increase the influence of grooves arranged on a striking face of each golf club head upon an amount of back spin imparted to a ball, and an appropriate amount of back spin corresponding to each iron is imparted to the ball.

BRIEF DESCRIPTION OF THE DRAWINGS

The present invention will be described with reference to the accompanying drawings, in which.

DESCRIPTION OF THE PREFERRED EMBODIMENTS

Preferred embodiments of the present invention will now be described with reference to the accompanying drawings.

Figure 1:
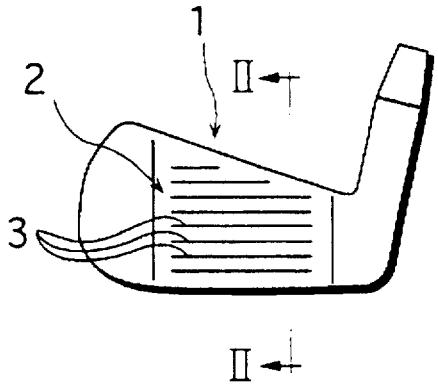
FIG. 1 is a front view showing a head of a golf club in a set of golf clubs according to the present invention.
Figure 2:
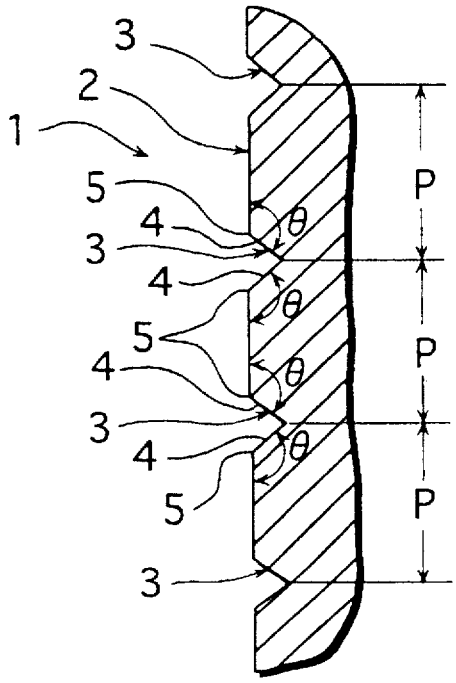
FIG. 2 is an enlarged section taken on line II—II in FIG. 1.

FIG. 1 and FIG. 2 show a head of a golf club in a set of golf clubs according to the present invention. FIG. 1 is a front view of the head 1, and FIG. 2 is an enlarged section of a striking face 2 side taken on line II—II in FIG. 1.

This set of golf clubs is "a set of iron clubs" including a number of iron clubs, for example, a set of seven irons numbered three through nine, a set of eight irons including the seven irons and a pitching wedge, or a set of nine to eleven irons including the eight irons and at least one of an alternative wedge, a sand wedge, or a #2 iron.

In the set of golf clubs of the present invention, the iron clubs are numbered serially and the set has a progressively increasing loft angle beginning with the long irons and progressing to the short irons, as commonly arranged in conventional sets of golf clubs. The club length is progressively decreased beginning with the long irons and progressing to the short irons, as commonly arranged in conventional sets of golf clubs. A head 1 of each club has a number of grooves 3 extending across a striking face 2, also as commonly arranged in conventional sets of golf clubs.

Irons of a set of golf irons are typically identified (numbered) two through nine, a pitching wedge, an alternative wedge, and a sand wedge. The irons having relatively low iron numbers are called long irons, and the irons having relatively high iron numbers are called short irons.

In the set of golf clubs according to the present invention, a cross-sectional angle θ of a corner portion 5 formed by the striking face 2 and a groove slope face 4 of a face line groove 3 in a cross section is progressively decreased beginning with the long irons and progressing to the short irons. In other words, the cross-sectional angle θ of the corner 5 joining the striking face 2 and the groove slope face 4 of the face line groove 3 in a cross section is progressively decreased beginning with an iron having the longest club length and progressing to an iron having the shortest club length.

Arranging the cross-sectional angle θ to decrease progressively beginning with the long irons and progressing to the short irons is herein defined as arranging the cross-sectional angle θ to be progressively decreased in accordance with each increase in the iron number.

It is possible to arrange the cross-sectional angle θ to decrease by stages from the long irons to the short irons instead of the aforementioned progressive decrease. Decreasing by stages is herein defined as arranging the cross-sectional angle θ so that a group of irons of neighboring iron numbers having the same cross-sectional angle θ exists, and the set of clubs as a whole has a gradually decreasing angle θ from the long irons to the short irons.

It is also possible to arrange the cross-sectional angle θ to decrease "progressively" and "by stages".

Therefore, in the present invention, the cross-sectional angle θ is decreased progressively, by stages, or progressively and by stages, beginning with the long irons and progressing to the short irons.

In this case, the cross-sectional angle θ is arranged within a range from 90° to 160°. The reason is that it is necessary to arrange the angle θ to be at least 90° in order to avoid being in contravention of the rules of golf, and when the angle θ is more than 160°, the grooves become effectless and it is impossible to obtain improvement in results upon an iron without grooves.

The grooves 3 are arranged at regular intervals P of at least 1.2 mm and at most 6.0 mm. The reason is that the intervals P shall have a length of at least quadruple of a groove width according to the rules of golf and it is necessary to arrange the intervals P to be at least 1. 2 mm in order to avoid being in contravention of the rules of golf, and when the intervals P are more than 6.0 mm, the grooves become effect less.

Figure 3A:
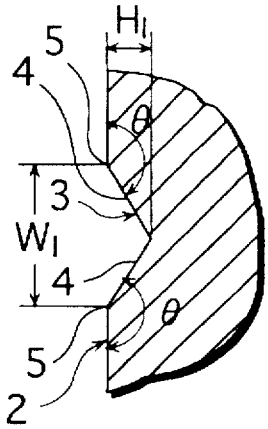
FIG. 3A is an enlarged section explaining a groove.
Figure 3B:
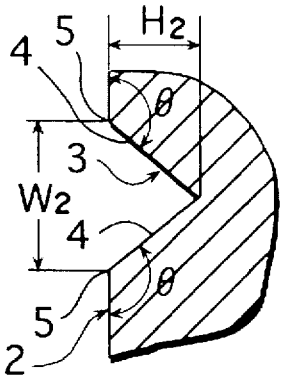
FIG. 3B is an enlarged section explaining a groove.
Figure 3C:
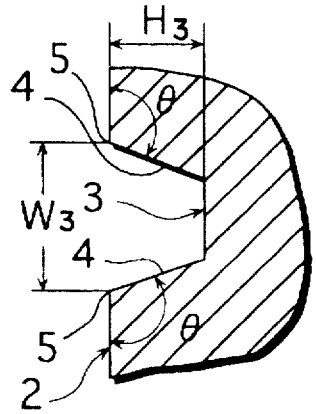
FIG. 3C is an enlarged section explaining a groove.
Figure 3D:
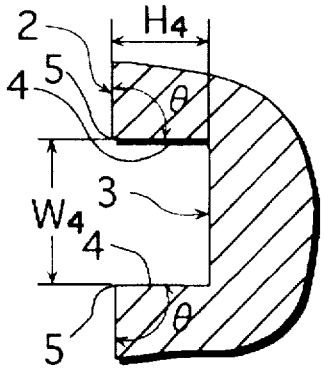
FIG. 3D is an enlarged section explaining a groove.

FIG. 3A, FIG. 3B, FIG. 3C, and FIG. 3D illustrate the cross-sectional angle θ of the corner portion 5 formed by the striking face 2 and the groove slope face 4 in a cross section of the groove 3, and the angle θ is 150° in FIG. 3A, 140° in FIG. 3B, 110° in FIG. 3C, and 90° in FIG. 3D. In FIG. 3A and FIG. 3B, the grooves 3 are V-shaped in cross section, and FIG. 3B shows the same groove 3 as in FIG. 2. In FIG. 3C and FIG. 3D, the grooves 3 have flat bottoms. In some cases, it is possible to arrange the bottoms of the grooves 3 to be arc-shaped in a cross section.

In FIG. 3A, FIG. 3B, FIG. 3C, and FIG. 3D, W indicates a width of the groove and H indicates a depth of the groove. As shown the groove width W is arranged to be at least 0.3 mm and at most 0.9 mm. In FIGS. 3A through 3D, the widths and the depths of the respective grooves are represented as $W_1$, $W_2$, $W_3$ and $W_4$ and $H_1$, $H_2$, $H_3$ and $H_4$, respectively, to indicate that, although these dimensions may be constant from club to club, they may also increase progressively from the long irons to the short irons, i.e. progressing from FIG. 3A to FIG. 3D. Thus, the width dimensions may increase progressively within the range from at least 0.3 mm to at most 0.9 mm. Likewise, the groove depth H is arranged to be at least 0.2 mm and at most 0.5 mm and, similarly, may progressively increase from 0.2 mm to 0.5 mm from the long irons to the short irons.

The reason for the indicated groove widths and groove depths is that a groove width W of less than 0.3 mm causes the groove to be effectless, a groove width W of more than 0.9 mm is in contravention of the rules of golf, a groove depth H of less than 0.2 mm causes the groove to be effectless, and a groove depth H of more than 0.5 mm is in contravention of the rules of golf.

FIG. 3A shows a groove 3 of a #3 iron of a first embodiment mentioned later of a set of golf clubs according to the present invention, FIG. 3B shows a groove 3 of a #4 iron of the set, FIG. 3C shows a groove 3 of a #7 iron of the set, and FIG. 3D shows a groove 3 of a #9 iron of the set. While the groove widths W maybe arranged to have the same dimensions in FIG. 3A, FIG. 3B, FIG. 3C, and FIG. 3D, as indicated before it is possible to freely change the groove widths from iron to iron as indicated by the groove widths $W_1$ through $W_4$ in the respective drawing figures.

Coefficient of friction upon impact between a ball and a striking face 2 increases progressively in accordance with a decrease in cross-sectional angle θ of corner portions 5 formed by the striking face 2 and groove slope faces 4 in a cross section of grooves 3. The cross-sectional angle θ decreases progressively from the long irons to the short irons, therefore an amount of back spin is gradually increased more effectively by the grooves 3 from the long irons to the short irons.

According to the set of golf clubs of the present invention, when a ball is shot with a long iron, such as the #2 iron, #3 iron, or #4 iron, less amount of back spin is imparted to the ball and the ball flies farther in comparison with a conventional long iron. When a ball is shot with a short iron, such as the #8 iron, #9 iron, pitching wedge, alternative wedge, or sand wedge, a greater amount of back spin is imparted to the ball whereby the ball stops better after landing, and this facilitates controlling the ball in comparison with a conventional short iron.

It is desirable to arrange the groove widths W to progressively increase within a range from 0.3 mm to 0.9 mm beginning with the long irons and progressing to the short irons. Moreover, it is desirable to arrange the groove depths H to progressively increase within a range from 0.2 mm to 0.5 beginning with the long irons and progressing to the short irons. The amount of back spin caused by the grooves 3 is thereby increased beginning with the long irons and progressing to the short irons. The groove widths W and the groove depths H are increased "progressively", "by stages", or "progressively" and "by stages" beginning with the long irons and progressing to the short irons. Increasing progressively is herein defined as arranging the groove widths W and the groove depths H to increase progressively in accordance with each increase in iron number. Increasing by stages is herein defined as arranging the groove widths W and the groove depths H so that a group of irons of neighboring iron numbers having the same groove widths W and the same groove depths H exists, and the set of clubs, as a whole, has gradually decreasing groove widths W and groove depths H from the long irons to the short irons.

Next, Table 1 shows embodiments of the present invention.

TABLE 1

| | Club Number (Iron) | #3 | #4 | #5 | #6 | #7 | #8 | #9 | PW |
|---|---|---|---|---|---|---|---|---|---|
| First Embodiment of the Present Invention | Angle (°) | 150 | 140 | 130 | 120 | 110 | 110 | 90 | 90 |
| | Groove Width (mm) | 0.7 | 0.7 | 0.7 | 0.7 | 0.7 | 0.7 | 0.7 | 0.7 |
| | Groove Depth (mm) | 0.20 | 0.29 | 0.35 | 0.35 | 0.35 | 0.35 | 0.35 | 0.35 |
| Second Embodiment of the Present Invention | Angle (°) | 150 | 150 | 150 | 135 | 135 | 135 | 90 | 90 |
| | Groove Width (mm) | 0.7 | 0.7 | 0.7 | 0.7 | 0.7 | 0.7 | 0.7 | 0.7 |
| | Groove Depth (mm) | 0.20 | 0.20 | 0.20 | 0.35 | 0.35 | 0.35 | 0.35 | 0.35 |
| Third Embodiment of the | Angle (°) | 150 | 145 | 140 | 135 | 130 | 125 | 120 | 115 |
| | Groove Width (mm) | 0.7 | 0.7 | 0.7 | 0.7 | 0.7 | 0.7 | 0.7 | 0.7 |

TABLE 1-continued

| | Club Number (Iron) | #3 | #4 | #5 | #6 | #7 | #8 | #9 | PW |
|---|---|---|---|---|---|---|---|---|---|
| Present Invention | Groove Depth (mm) | 0.20 | 0.25 | 0.29 | 0.35 | 0.35 | 0.35 | 0.35 | 0.35 |
| Conventional Set of Golf Clubs | Angle (°) | 135 | 135 | 135 | 135 | 135 | 135 | 135 | 135 |
| | Groove Width (mm) | 0.7 | 0.7 | 0.7 | 0.7 | 0.7 | 0.7 | 0.7 | 0.7 |
| | Groove Depth (mm) | 0.35 | 0.35 | 0.35 | 0.35 | 0.35 | 0.35 | 0.35 | 0.35 |

Table 1 shows first, second, and third embodiments of the present invention and a conventional set, each in a set of eight golf irons including #3 through #9 irons and a pitching wedge (PW). The intervals between the grooves are the same in all the iron clubs.

In the first embodiment, which is an example of decreasing "progressively" and "by stages", the angle decreases progressively from the #3 iron to the #9 iron, and the angle decreases by stages from the #8 iron to the #9 iron. The set as a whole has a gradually decreasing angle from the long irons to the short irons.

In the second embodiment, which is an example of decreasing "by stages", the angle decreases by stages from the #3 through #9 irons and the pitching wedge. That is to say, this set consists of a group of the #3 iron, #4 iron, and #5 iron wherein the angle is arranged to be 150°, a group of the #6 iron, #7 iron, and #8 iron wherein the angle is arranged to be 135°, and a group of the #9 iron and the pitching wedge wherein the angle is arranged to be 90°.

In the third embodiment, which is an example of decreasing "progressively", the angle decreases progressively beginning with the long irons and progressing to the short irons.

In the conventional example, the angle is arranged to be 135° in each of the #3 through #9 irons and the pitching wedge. The groove widths and the groove depths are arranged to be substantially equivalent in all the irons of the first, second, and third embodiments of the present invention and the conventional set.

Concerning each of the first, second, and third embodiments of the present invention and the conventional set, balls were actually shot with the #3 (a long iron), #6 iron (a middle iron), and #9 iron (a short iron) using a machine for shooting balls. The machine was arranged to swing at 45 m/s in club head speed in case of using a #1 wood (a driver). The results of the experiment are shown in Table 2.

TABLE 2

| | Club Number (Iron) | #3 | #6 | #9 |
|---|---|---|---|---|
| First Embodiment of the Present Invention | Back Spin (r.p.m.) | 4000 | 5050 | 8350 |
| | Carry (yard) | 175 | 160 | 132 |
| | Run (yard) | 22 | 9 | 2 |
| | Total (yard) | 197 | 169 | 134 |
| Second Embodiment of the Present Invention | Back Spin (r.p.m.) | 4000 | 4950 | 8350 |
| | Carry (yard) | 175 | 158 | 132 |
| | Run (yard) | 22 | 10 | 2 |
| | Total (yard) | 197 | 168 | 134 |

TABLE 2-continued

| | Club Number (Iron) | #3 | #6 | #9 |
|---|---|---|---|---|
| Third Embodiment of the Present Invention | Back Spin (r.p.m.) | 4000 | 4950 | 7900 |
| | Carry (yard) | 175 | 158 | 131 |
| | Run (yard) | 22 | 10 | 4 |
| | Total (yard) | 197 | 168 | 135 |
| Conventional Set of Golf Clubs | Back Spin (r.p.m.) | 4150 | 4950 | 7300 |
| | Carry (yard) | 176 | 158 | 130 |
| | Run (yard) | 16 | 10 | 6 |
| | Total (yard) | 192 | 168 | 136 |

In Table 2, in comparing the first embodiment of the present invention with the conventional set, the back spin of the #3 iron (the long iron) was decreased by 150 r.p.m., the back spin of the #6 iron (the middle iron) was increased by 100 r.p.m., and the back spin of the #9 iron (the short iron) was increased by 1050 r.p.m..

Moreover, in comparing the first embodiment of the present invention with the conventional set, the total distance of the #3 iron was increased by 5 yards, the total distance of the #6 iron was increased by 1 yard and the run was decreased by 1 yard, and the total distance of the # 9 iron was decreased by 2 yards and the run was decreased by 4 yards, which indicates that a good shooting control was obtained and the ball ran only a short distance after landing.

In comparing the second embodiment of the present invention with the conventional set, the back spin of the #3 iron (the long iron) was decreased by 150 r.p.m., the back spin of the #6 iron (the middle iron) was identical, and the back spin of the #9 iron (the short iron) was increased by 1050 r.p.m..

Moreover, in comparing the second embodiment of the present invention with the conventional set, the total distance of the #3 iron was increased by 5 yards, the carry, run, and total distance of the #6 iron were identical, and the total distance of the # 9 iron was decreased by 2 yards and the run was decreased by 4 yards, which indicates that a good shooting control was obtained and the ball ran only a short distance after landing.

In comparing the third embodiment of the present invention with the conventional set, the back spin of the #3 iron (the long iron) was decreased by 150 r.p.m., the back spin of the #6 iron (the middle iron) was identical, and the back spin of the #9 iron (the short iron) was increased by 600 r.p.m..

Moreover, in comparing the third embodiment of the present invention with the conventional set, the total distance of the #3 iron was increased by 5 yards, the carry, run, and total distance of the #6 iron were identical, and the total distance of the #9 iron was decreased by 1 yard and the run was decreased by 2 yards, which indicates that a good shooting control was obtained and the ball ran only a short distance after landing.

The results described in the foregoing show that a ball shot by the long iron flies farther, and a ball shot by the short iron is well-controlled and runs only a short distance after landing according to the first, second, and third embodiments of the present invention.

Therefore, according to the present invention, an appropriate amount of back spin corresponding to each club can be imparted to the ball without changing the type of swing, and the ball flies farther by using the long iron and a good shooting control can be attained by using the short iron.

While preferred embodiments of the present invention have been described in this specification, it is to be understood that the invention is illustrative and not restrictive, because various changes are possible within the spirit and indispensable features. For example, while it is preferable to arrange the intervals P of the grooves 3 to be identical in all the irons in the set, it is possible to freely change the intervals P of the grooves 3 from iron to iron. If the intervals P are arranged to decrease progressively beginning with the long irons and progressing to the short irons, it is possible to further decrease the amount of back spin in using the long irons and further increase the amount of back spin in using the short irons.

What is claimed is:

1. A set of golf clubs including a number of golf clubs numbered serially and having a gradually increasing loft angle from long irons to short irons, wherein the improvement comprises arranging angles of corner portions formed by a striking face and groove slope faces in a cross-section of a number of face line grooves extending across the striking face to decrease, while arranging the face line grooves with groove widths which increase within a range from 0.3 mm to 0.9 mm, progressively from the long irons to the short irons.

2. A set of golf clubs including a number of golf clubs numbered serially and having a gradually increasing loft angle from long irons to short irons, wherein the improvement comprises arranging angles of corner portions formed by a striking face and groove slope faces in a cross-section of a number of face line grooves extending across the striking face to decrease, while arranging the face line grooves with groove widths which increase within a range from 0.3 mm to 0.9 mm, by stages from the long irons to the short irons.

3. A set of golf clubs including a number of golf clubs numbered serially and having a gradually increasing loft angle from long irons to short irons, wherein the improvement comprises arranging angles of corner portions formed by a striking face and groove slope faces in a cross-section of a number of face line grooves extending across the striking face to decrease, while arranging the face line grooves with groove widths which increase within a range from 0.3 mm to 0.9 mm, progressively and by stages from the long irons to the short irons.

4. The set of golf clubs as set forth in claim 1, claim 2, or claim 3, wherein said angles of the corner portions are arranged within a range from 90° to 160°.

5. The set of golf clubs as set forth in claim 1, claim 2, or claim 3, wherein the face line grooves are arranged at regular intervals of at least 1.2 mm and at most 6.0 mm.

6. The set of golf clubs as set forth in claim 1, claim 2, or claim 3, wherein the face line grooves are arranged to have groove depths which progressively increase within a range from 0.2 mm to 0.5 mm from the long irons to the short irons.

* * * * *